United States Patent [19]

Canney

[11] 4,111,181

[45] Sep. 5, 1978

[54] COMBUSTION AIR SYSTEM

[76] Inventor: John J. Canney, 82 Falcon St., Needham, Mass. 02192

[21] Appl. No.: 778,165

[22] Filed: Mar. 16, 1977

[51] Int. Cl.[2] ..... F24C 1/14

[52] U.S. Cl. ..... 126/77; 126/112

[58] Field of Search ..... 126/77, 163 R, 163 A, 126/112, 15 R, 15 A; 110/8 A; 99/473, 474; 98/38 A, 38 R; 137/604

[56] References Cited

U.S. PATENT DOCUMENTS

| | | | |
|---|---|---|---|
| 376,454 | 1/1888 | Stephenson | 126/15 R X |
| 544,870 | 8/1895 | Thompson | 126/77 X |
| 1,293,074 | 2/1919 | Fraas | 126/112 |
| 1,341,580 | 5/1920 | Pelton | 126/77 |
| 2,607,335 | 8/1952 | Harding | 126/77 X |
| 3,168,088 | 2/1965 | Martin et al. | 126/77 |
| 3,875,874 | 4/1975 | Altmann | 110/8 A |

*Primary Examiner*—William E. Wayner
*Assistant Examiner*—William E. Tapolcai, Jr.

[57] ABSTRACT

A combustion air sytem for wood fired boilers, furnaces, stoves and other heating apparatus; the combustion air system including an air-tight combustion chamber, within which a wood fuel is burned upon a grate, primary air being introduced from below the grate, so as to burn the wood, and a secondary air being introduced into an air conducting tube in the crown sheet of the combustion chamber, which mixes with volatile gases from the burning wood, so as to burn the same, and produce additional heat.

3 Claims, 2 Drawing Figures

Fig. 1
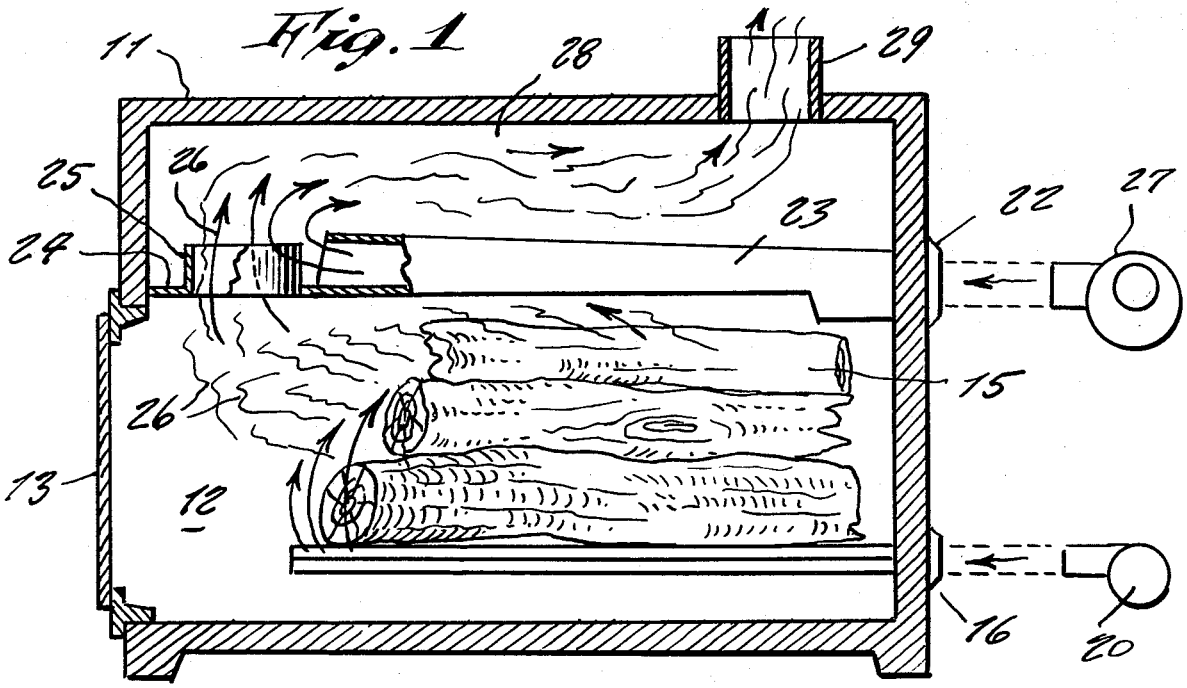
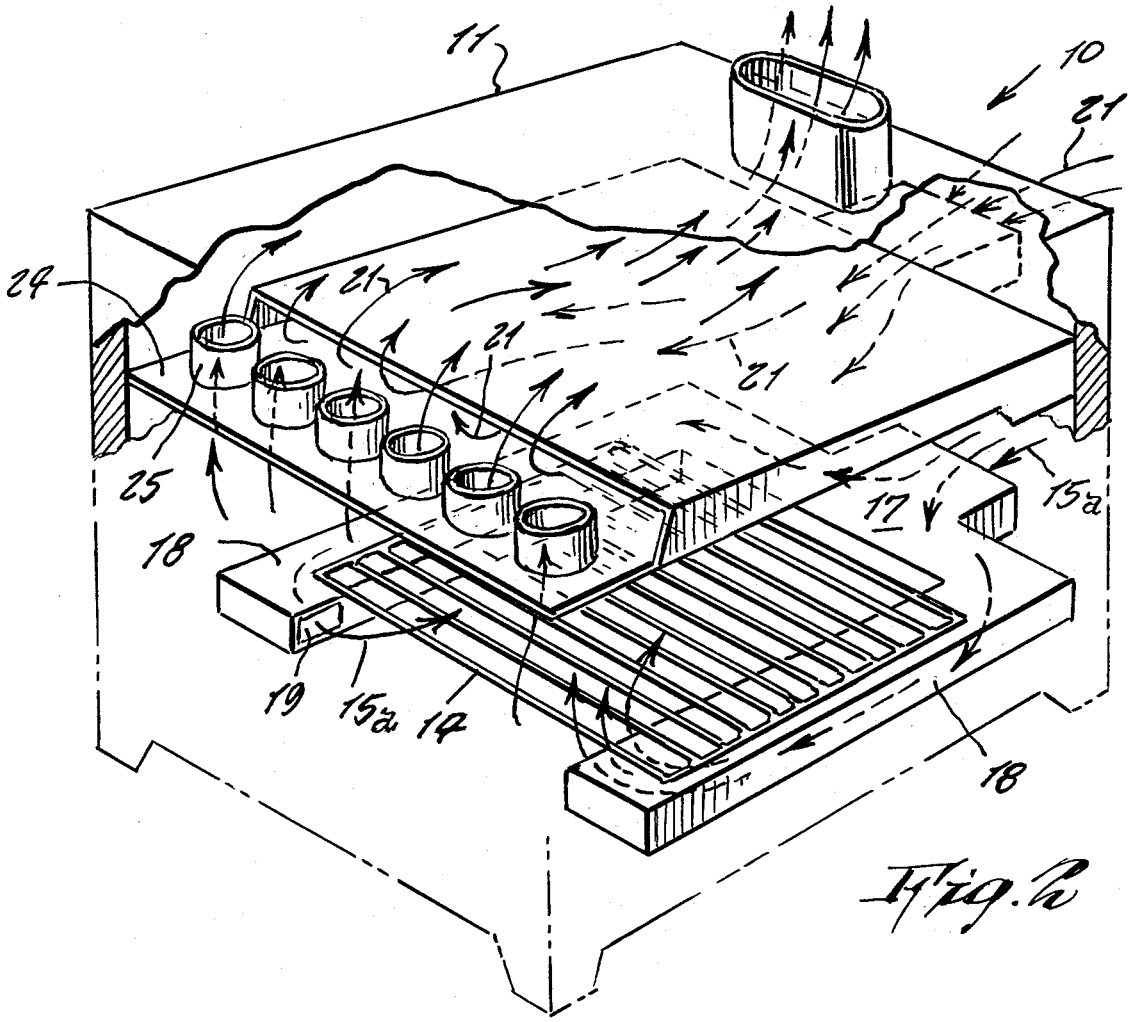
Fig. 2

COMBUSTION AIR SYSTEM

This invention relates generally to combustion air systems.

A principal object of the present invention is to provide a combustion air system, which regulates and improves the combustion of wood, by introduction of pre-heated primary and secondary air into an air-tight combustion chamber.

Another object is to provide a combustion air system, wherein the amount of heat that is produced is thus increased by a large percentage.

Still another object is to provide a combustion air system wherein the burning time of the wood is noticeably increased, due to the configuration of the combustion chamber, and thermostatic modulation of dampers and/or alternate blowers, which supply a correct quantity of combustion air.

Still a further object is to provide a combustion air system, which may be used in space heating and cooking stoves, hot air gravity or forced circulation furnaces, hot water or steam boilers.

Other objects are to provide a combustion air system which is simple in design, inexpensive to manufacture, rugged in construction, easy to use and efficient in operation.

These, and other objects, will be readily evident, upon a study of the following specification and the accompanying drawing wherein:

FIG. 1 is a side cross-sectional view of a furnace, incorporating the present invention; and FIG. 2 is a perspective view thereof, shown partly broken away, so as to illustrate the interior structure.

Referring now to the drawing in greater detail, the reference numeral 10 represents a combustion air system, according to the present invention, and which is illustrated incorporated into a furnace 11, having an air tight combustion chamber 12, closable by an air-tight door 13. Within the air-tight chamber 12, there is located a grate 14, upon which wood 15 may be loaded for burning. Primary air 15a is introduced through a damper 16, in the rear of the combustion chamber floor at 17, the primary air being passed therefrom through air conducting tubes 18 forwardly, and out through openings 19 thereof, under the grate, and upwardly to the wood. It is to be noted that the tubes 18 are heated by the burning wood, so that the air leaving the tube openings 19 is thus pre-heated before entering the combustion chamber 12. Such pre-heated air insures a more complete combustion of the wood. An alternate forced draft fan 20 may be provided, for introduction of the primary air to the damper 16.

A secondary air 21 is introduced, through a damper 22, into air conducting tube 23, in the crown sheet 24 of the combustion chamber, the secondary air leaving the tube 23 adjacent a row of pipes or ducts 25, extending through the crown sheet 24, so that unburned, volatile gases 26, passing upwardly from the combustion chamber 12, and through the ducts 25, thus become mixed with the secondary air 21. This secondary air is heated inside the air conducting tube 23, because the same is located directly above the wood that is burning, so that the secondary air, mixing with the volatile gases, is thus heated. This causes the volatile gases to be burned, and thus produce additional heat. The burning of these volatile gases eliminates the situation of such gases going up a flue, and depositing creosote on flue surfaces. The amount of heat thus produced is vastly increased. The secondary air thus maximum heated insures ignition of the volatile gases.

Alternately, an oil or gas burner 27 may be used, leading to the secondary air inlet damper 22. In dual fuel systems, such as wood and oil combustion burners, the primary fuel being wood, an oil burner can be installed in place of the secondary air inlet damper.

The mixing volatile gases and secondary air generates a heat in the chamber 28 above the crown sheet, or smoke shelf, before passing to the smoke outlet 29.

Thus, there is provided a novel combustion air system.

While various changes may be made in the detail construction, it is understood that such changes will be within the spirit and scope of the present invention, as is defined by the appended claims.

What I now claim is:

1. A combustion air system, comprising in combination, a furnace or the like having an air-tight combustion chamber, a grate above a combustion chamber floor, said grate supporting wood for being burned, a plurality of air tubes below said grate supplying primary air therethrough and into said air-tight combustion chamber by pre-heating said primary air, air outlets along said tubes directing said primary air to an underside of said grate and to said wood; an air conducting tube in a crown sheet of said combustion chamber being located above said burning wood, said air conducting tube in said crown sheet introducing secondary air at an outlet of said tube and adjacent a plurality of nozzles or pipes communicating through said crown sheet and with said combustion chamber containing said wood, whereby volatile gases from said chamber through said nozzles mixes with said secondary air and is ignited, creating additional heat above a smoke shelf prior to passing out a smoke outlet.

2. The combination as set forth in claim 1, wherein a primary air inlet damper and a secondary air inlet damper introduce said primary air and said secondary air into said tubes.

3. The combination as set forth in claim 1 wherein a forced air draft fan introduces said primary air.

* * * * *